United States Patent [19]

Masi

[11] 4,108,436

[45] Aug. 22, 1978

[54] AIRED GRIP FOR TENNIS RACKETS

[76] Inventor: Lamberto Masi, 20016 Pero (Milan), Italy

[21] Appl. No.: 749,058

[22] Filed: Dec. 9, 1976

[30] Foreign Application Priority Data

Dec. 16, 1975 [IT] Italy ..... 30337 A/75
Mar. 3, 1976 [IT] Italy ..... 21071 A/76

[51] Int. Cl.[2] ..... A63B 49/08
[52] U.S. Cl. ..... 273/75; 74/551.9
[58] Field of Search ..... 273/67 R, 67 DA, 72 R, 273/72 A, 73 R, 73 J, 75, 81 R, 81.5, 81.6; 74/551.9; 145/61 R

[56] References Cited

U.S. PATENT DOCUMENTS

| | | | |
|---|---|---|---|
| 606,541 | 6/1898 | Grotenhuis et al. | 74/551.9 |
| 2,086,062 | 7/1937 | Bray | 273/73 J X |
| 3,489,031 | 1/1970 | Meier | 273/75 X |
| 3,645,008 | 2/1972 | Delsack | 273/73 J X |

FOREIGN PATENT DOCUMENTS

| | | | |
|---|---|---|---|
| 858,205 | 5/1940 | France | 273/75 |
| 197,052 | 4/1908 | Fed. Rep. of Germany | 74/551.9 |
| 2,348,143 | 3/1975 | Fed. Rep. of Germany | 273/75 |
| 2,514,059 | 10/1975 | Fed. Rep. of Germany | 273/75 |
| 256,312 | 12/1927 | Italy | 273/75 |
| 470,891 | 5/1969 | Switzerland | 273/75 |
| 20,628 of | 1891 | United Kingdom | 273/75 |
| 22,775 of | 1896 | United Kingdom | 74/551.9 |
| 16,851 of | 1901 | United Kingdom | 74/551.9 |
| 432,452 | 7/1935 | United Kingdom | 273/73 J |

*Primary Examiner*—Richard J. Apley
*Attorney, Agent, or Firm*—Lane, Aitken, Dunner & Ziems

[57] ABSTRACT

A grip for tennis rackets and the like has an elongated shaft with a longitudinal hole extending axially from the free end and a plurality of grooves on the outer surface. A tubular reinforcing member provided with a plurality of perforations is disposed within the hole. The shaft is provided with a plurality of passages which extend radially from the longitudinal hole to the outer surface, with passages provided on the free end of the shaft. A protective cap is attached to the free end of the shaft, and a plurality of protrusions on the inner surface of the cap space the cap from the shaft to define a ventilation chamber. A central opening in the cap is aligned with the longitudinal hole, and the perforations in the reinforcing member are in fluid communication with the hole and the grooves on the outer surface to provide complete ventilation of the grip.

17 Claims, 12 Drawing Figures

AIRED GRIP FOR TENNIS RACKETS

BACKGROUND OF THE INVENTION

The present invention relates to improvements for grips of tennis rackets provided with means for reducing if not eliminating the danger of the racket slipping from the player's hand as a consequence of perspiration.

During a tennis match, usually the hand of the tennis player is subjected to an intense perspiration which wets the leather covering of the racket's handle, thereby impairing the grip so that the racket can even slip out of the player's hand.

It has been already suggested to effect seration of the racket grip by providing, within the grip, a longitudinal hole communicating with transversal holes which extend radially to the outer surface of the grip where they open into corresponding holes provided in the leather covering.

The racket grips known do not provide, however, any seration near the free end of the grip which same comes into contact with the part of the hand which perspires most, namely, where the forefinger joins the palm cavity.

Hence it is a main object of the invention to provide an improved racket grip with aeration means starting from the free end of racket handle.

The grip for tennis rackets according to the invention, includes a longitudinal hole axially extending within said grip, starting from the free end thereof, and a plurality of cross bores or passages extending from said longitudinal hole towards the grooved outer surface of the handle as well as a protective cap applied to the free end of the racket grip and having, on its bottom surface, a central opening aligned with said longitudinal hole, transversal holes or passages being provided up to the lower edge of the grip, some of them cutting through the cross plane of the grip's free end. Furthermore, between the grip's end and the cap's bottom opposite these two, there is provided and formed an aeration chamber communicating through the transversal end passages of the grip with holes provided on the side walls of said cap.

The aeration of the end portion of the racket handle may be furthermore improved by providing on the handle's external surface small netlike cavities crossing each other in correspondence of each transversal passage and opening into the aeration chamber of the cap.

A racket handle of the foregoing design allows for good ventilation of the player's hand. However, for further improving and uniformly distributing the ventilation effect on the whole handle, as well for increasing the resistance of same according to a modified embodiment of the invention, the cavities are formed longitudinally with respect to the handle, starting from the end aeration chamber. The cavities have a width which is less than the the diameter of the cross passages and are spaced at a distance which is less than the distance between said passages, so that the whole surface of the handle is provided with a plurality of small longitudinal cavities so formed as to guarantee a better ventilation effect and provide for an increased slip resistance of the handle.

The ventilation effect is moreover improved by the grip covering tape which is formed with holes having a greater diameter than the width and the distance between adjacent grooves, which ensures that each of the tape bores is always in communication with at least a longitudinal groove, so assuring an aeration effect upon the whole grip surface. From practical tests, it has been found that a grip (handle) for a racket according to the present invention, has given very good results at any point of the grip and has allowed a considerable reduction of perspiration of the hand under strain.

BRIEF DESCRIPTION OF THE DRAWINGS

These and other characteristics of the grip for tennis racket according to the present invention will result from the following detailed description and the accompanying drawings, in which.

DESCRIPTION OF THE PREFERRED EMBODIMENTS

Although in the illustrated embodiments there is merely shown a part of the grip portion 1 of the handle of a generical wooden tennis racket, it is obvious that the improvements of the invention may be applied as well to the grip of a racket made of metal or reinforced synthetic resins.

The grip 1 is provided (FIG. 6) starting from its free end, with a longitudinal hole 2 adapted to receive a tubular reinforcing element 3 of nylon or any other material suitable to restore the mechanical resistance as well as the weight of the racket grip. Said reinforcing element 3 may be either forced into the hole 2 or be attached to the closed end of said longitudinal hole by means of a screw 3'.

The racket grip may have any cross sectional form desired, although it will be preferably octogonal in shape, as in the illustrated embodiments.

Figures 1, 2, 3, 4, 5, 6, 7, 8:
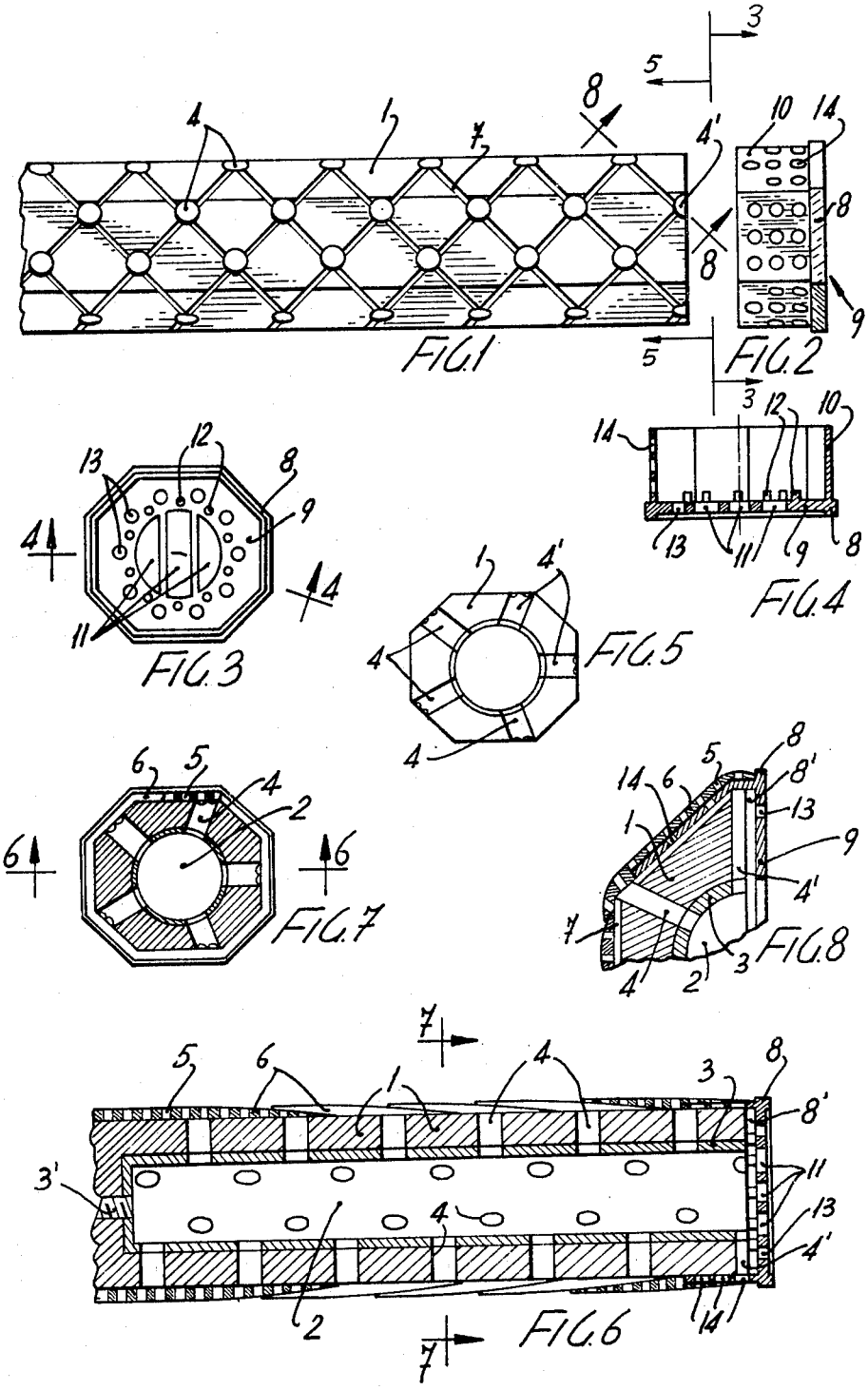
FIG. 1 is a view of a racket grip according to the invention before the leather covering has been applied thereto.
FIG. 2 is a view of the protective cap to be normally applied to the free end of said grip.
FIG. 3 is a plan view of the cap as seen along line 3—3 of FIG. 2.
FIG. 4 is a cross-sectional view taken along the broken line 4—4 of FIG. 3.
FIG. 5 is a head-on view of the free end of the grip, taken along the line 5—5 of FIG. 1.
FIG. 6 is a longitudinal sectional view of the grip having the protective cap as well as the leather covering tape applied thereto.
FIG. 7 is a cross-sectional view taken along the line 7—7 of FIG. 6.
FIG. 8 is a longitudinal sectional view of the grip complete with protective cap and covering tape, taken along the oblique plane 8—8 of FIG. 1.

As illustrated in the sectional views of FIG. 6 and 7, the grip 1 and the tubular reinforcing element 3 have formed therein, in aligned corresponding positions, a plurality of cross bores or vents 4 which, starting from the longitudinal hole 2, extend radially to the outer surface of grip 1. Openings or holes 5 in the perforated tape 6, which normally covers the racket grip 1, provide air flow means through the grip via the aligned vents 4 and the openings.

In the view of FIG. 1, the vents 4 are formed by substantially radially-extended bores which are aligned in longitudinally-disposed rows with respect to the grip itself, with the vents in each row being shifted or staggered half a step with respect to the vents in the adjacent row. The staggered disposition of the longitudinal rows of vents 4 readily permits the provision of a network of grooves 7 on the outer surface of the grip 1. Each of the parallel-disposed grooves 7 is oriented at an angle with respect to a longitudinal line on the surface of the grip 1, and interconnects the plurality of vents 4. As shown in FIG. 1, one set of parallel grooves 7 interconnects the vents 4 at one angular orientation, and a second set of the grooves 7 is disposed perpendicularly with respect to the first set. The network of crossing grooves 7 which intersect at the vents 4 provide greater fluid communication between the vents 4 and the holes 5 in the covering tape 6, thereby increasing the aired surface of the racket's grip.

Obviously the dimensions and the disposition of the cross aeration vents 4 could also be modified with respect to the illustrated embodiments so as to better suit different types or dimensions of the grip. By way of example, the longitudinal hole 2 may have a length between 8 and 17 cm, with an inner diameter between 10 and 20 mm. The cross vents 4 may have a diameter of 3–8 mm., with a distance between openings of the same row of about 10–25 mm. according to necessity. Obviously the above indicated dimensions may be suitably varied or combined to better adapt to any type of tennis racket and to the size of the grip.

According to the invention and as shown in the views of FIG. 1, 5 and 6, the cross vents 4 are formed up to the longitudinal edge of the free end of grip 1 where cross bores 4' cut the transversal plane of said free end, or the plane perpendicular to the longitudinal axis of the grip. This allows for the direct fluid communication of the vents 4 and the grooves 7 with an aeration chamber 8' formed between the ends of grip 1 and a protective cap 8, as it will be clarified later, and which is arranged on the free end of the grip.

The shape and constitution of the protective cap 8 in moulded plastic material is illustrated in the views of FIGS. 2, 3, 4 and 7 of the drawings.

The protective cap 8 substantially comprises a bottom wall or surface 9 and lateral walls 10 conforming to the shape of the cross section of grip 1. The cap bottom wall 9 has apertures 11 which are aligned with the longitudinal passage 2 in grip 1, as well as a plurality of projections or spacing elements 12 disposed on its inner side, which are directed towards the free end of grip 1 when the cap 8 is properly positioned on the grip, as shown in FIG. 6.

In this manner, an annular aeration chamber 8' is formed between the free end of the grip 1 and the cap bottom wall 9, as shown in the sectional view of FIG. 6. Holes 13 for the passage of air are formed on the bottom wall 9, which are concentrically located around the central opening 11 and the spacing elements 12. Further, air passage holes 14 are arranged on the cap lateral walls 10 as shown in the several figures.

From the foregoing reference to FIGS. 6 and 8, it is therefore noted that the end cross bores 4' communicate directly with the chamber 8' formed between the cap bottom wall 9 and the free end of grip 1. The cross bores 4' can either be in direct communication with aeration holes 14 on the lateral walls 10 of cap 8 and the holes 5 of the covering tape 6, respectively, or in direct communication with holes 5 and 14 of the covering tape 6 and of cap 8, respectively, by means of the grooves 7 which extend from each of the end cross bores 4' and the chamber 8', as it is clearly shown in FIG. 1.

The oblique plane section of FIG. 8 clearly shows the path of air flow in the end portion of the grip 1. The air can flow through apertures 11 on the bottom wall 9 of the cap 8, into the aeration chamber 8', through the cross bores 4' and grooves 7, and through the holes 14 and 5, respectively, in the lateral wall 10 of the cap and the covering tape 6.

By the illustrated disposition of cross bores or vents 4,4' and of cap 8, an effective ventilation of the grip end portion is provided, which substantially reduces or eliminates the perspiration of the hand palm coming into contact with the grip. Owing to the fact that, in general, the portion of the hollow of the hand extending towards the lateral edge of the hand itself has a more intense perspiration, the possibility of aeration increase the efficaciousness of the grip on the racket's handle.

According to the embodiment illustrated in the remaining figures, the grip 1 can be provided, on its outer surface, with a plurality of longitudinal grooves 17 extending from the grip, wherein said grooves are communicating with an aeration chamber 18' formed between the free end of the grip itself and the bottom of a protective cap 18. The longitudinal grooves are formed along the whole length of the grip, preferably extending beyond point 16' where the covering tape 16 normally ends, for instance for about 1 cm., as shown by 17' in FIG. 9. The improved air circulation through the grooves 17 and consequently through the holes 15 of the covering tape 16 will be understood from the following description.

To achieve an improved and uniform ventilation effect on the whole grip, it has been determined that, the grooves 17 preferably have a V-shape of a predetermined maximum width, as viewed from the end surface of the grip, and said width must be smaller than the diameters of the cross passages 4, and further the distance between adjacent grooves must be always smaller than the distance between adjacent longitudinal rows of said passages 4. In this way the grip surface is provided with a plurality of small longitudinal grooves, which do not weaken the strength of the racket grip, but at the same time provides a large ventilation surface in contact with the holes of the perforated covering tape 16.

As an illustrative example only, the grooves 17 may have a maximum width 1 between 1.3 and 2.5 mm., a depth $p$ between 1 and 2 mm., and a distance $d$ of 2.5 to 4.5 mm., according to the need, with the distance determined between the symmetry axis of adjacent grooves.

Figure 9:
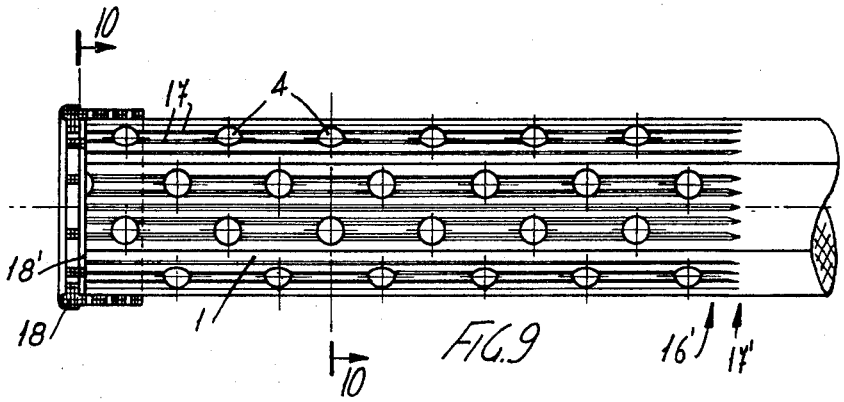
FIG. 9 is a view of an alternate embodiment of a tennis racket without the covering tape.
Figure 10:
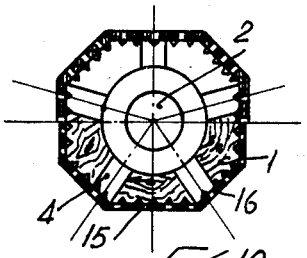
FIG. 10 is a cross-sectional view taken along the broken line 10—10 of FIG. 9, in the lower part there being shown the covering tape normally wrapping the racket grip.
Figure 11:
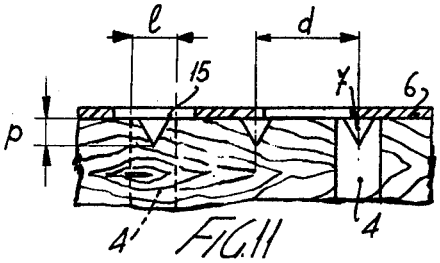
FIG. 11 is a partial enlarged sectional view illustrating the characteristics and the relations existing between the grooves and the various aeration vents.

From FIGS. 9, 10 and 11 of the enclosed drawings, it can be seen that with the above dimensions each cross bore or passage 4 communicates with one or two of the longitudinal grooves 17, and there are at least one longitudinal groove between adjacent rows of passage, thus increasing the grip surface ventilation.

Figure 12:
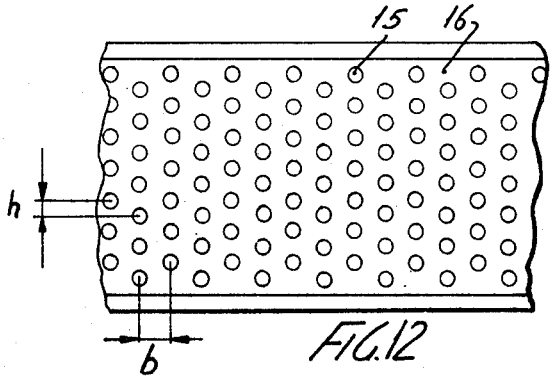
FIG. 12 is a plan view of a portion of the covering leather tape for the racket grip, suitably modified according to the invention.

Another essential characteristic for obtaining an efficaceous effect of grip ventilation consists in the disposition and shape of holes 15 on the covering tape 16. In fact, as shown in FIG. 10, 11, 12 of the annexed drawings it is necessary that all of the holes 15 be in communication with at least one longitudinal groove 17 and/or a passage 4, in order to achieve a uniform ventilation effect on the whole grip. In fact, if the sizes of grooves and tape holes 15 should be such as to have some holes of the tape completely closed, the grip ventilation effect would be reduced in said zone. Therefore, according to the invention, it has been found that the diameter of said holes 15 must be greater than the groove 17 width, that is between about 2.5 and 3.5 mm., with a step or spacing in the longitudinal direction *b* of 3 to 6 mm. between the holes in adjacent rows, as shown in FIG. 12, and a distance *h* of 2 to 3 mm. between adjacent rows of holes in the direction perpendicular to the longitudinal axis or the width of the tape. Besides that, the tape 16 should be of a greater width than the conventional ribbons, for instance twice, such as between about 45 and 55 mm., thus reducing the superimposition areas of the overlapping tape along the lateral, not-holed bands of the spirally-wound tape on the grip. This gives the certainty that each hole 15 of the tape is always in communication with one or two longitudinal grooves 17 of the racket's handle or grip, as schematically shown in FIG. 11, which is an enlarged view of the grip, showing, as an example, the orientation of cross bores 4, longitudinal grooves 17 and holes 15 of the covering tape 16.

It is understood that what has been said above and shown in the annexed drawings with reference to a general wooden grip of a tennis racket can be easily applied to any kind of grips, for instance, metal or other types of rackets, without departing from the principles of the invention.

What is claimed is:

1. A handle for tennis rackets and the like, comprising:

an elongated shaft defining a gripping portion and having a longitudinal bore extending axially from the free end of said shaft;

a plurality of passages in said shaft, said passages extending radially from said bore to the outer surface of said shaft, with at least one of said passages being disposed at least partially in the plane of the free end of said shaft;

a plurality of grooves disposed on the outer surface of said shaft;

a tubular reinforcing member disposed within said bore, said tubular member having a plurality of holes extending through the wall of said member and in fluid communication with said passages and grooves;

a cap attached to the free end of said shaft and having a sidewall extending over the free end portion of said shaft and an end wall disposed adjacent to said free end, said sidewall having a plurality of holes extending therethrough, and said end wall having a central aperture aligned with said bore; and a ventilation chamber defined between the free end of said shaft and the adjacent inner surface of said end wall, and in fluid communication with said grooves and said holes in said sidewall, said bore, passages, grooves, holes and ventilation chamber being in fluid communication and cooperating to form a plurality of fluid flow paths therethrough to ventilate said shaft.

2. A handle for tennis rackets as set forth in claim 1, further including a plurality of spacing protrusions disposed on the inner surface of said end wall.

3. A handle for tennis rackets as set forth in claim 2, wherein said spacing protrusions are peripherally disposed around said central aperture.

4. A handle for tennis rackets as set forth in claim 3, further including a plurality of holes in said end wall for the passage of air to said ventilation chamber.

5. A handle for tennis rackets as set forth in claim 4, wherein said holes in said end wall for the passage of air are peripherally disposed around said central aperture.

6. A handle for tennis rackets as set forth in claim 1, further including a perforated tape disposed on the outer surface of said shaft.

7. A handle for tennis rackets as set forth in claim 6, wherein said grooves comprise a first set of parallel grooves, each groove of said first set being disposed at an angle with respect to the longitudinal direction of the outer surface of said shaft, and a second set of parallel grooves, each groove of said second set intersecting each groove of said first set at the point where each of said plurality of holes penetrates the outer surface of said shaft.

8. A handle for tennis rackets set forth in claim 7, wherein the perforations of said perforated tape are so dimensioned that with said tape disposed on said shaft, said perforations are aligned radially with said grooves.

9. A handle for tennis rackets as set forth in claim 1, wherein the holes in said tubular reinforcing member extend to the end of said member disposed adjacent to the free end of said shaft, said holes being radially aligned with said passages in said shaft.

10. A handle for tennis rackets as set forth in claim 6, wherein one end of each of said grooves is in fluid communication with said ventilation chamber, each of said grooves having a width smaller than the diameter of each of said holes in said shaft, and the distance between adjacent grooves being smaller than the distance between adjacent passages.

11. A handle for tennis rackets as set forth in claim 10, wherein said grooves are parallel and are disposed in parallel relationship with respect to the longitudinal direction of the outer surface of said shaft.

12. A handle for tennis rackets as set forth in claim 10, wherein the diameter of each of said perforations of said perforated tape is larger than the width of each of said grooves.

13. A handle for tennis rackets as set forth in claim 12, wherein the diameter of each of the perforations in said perforated tape is between 2.5 and 3.5 mm.

14. A handle for tennis rackets as set forth in claim 11, wherein the longitudinal length of said grooves is greater than the longitudinal extend of said perforated tape disposed on said shaft.

15. A handle for tennis rackets as set forth in claim 11, wherein each of said grooves has a V-shaped cross section, a maximum width between 1.3 and 2.5 mm., a depth between 1 and 2 mm., and a separation distance of between 2.5 and 4.5mm between the axes of adjacent grooves.

16. A handle for tennis rackets as set forth in claim 11, wherein the perforations of said perforated tape are disposed in parallel rows, with a separation distance of 2 to 3 mm. between adjacent rows of perforations, and with the distance between adjacent perforations within each row being between 3 to 6 mm.

17. A handle for tennis rackets as set forth in claim 15, wherein said perforated tape has a width between 45 and 55 mm.

* * * * *